US009765534B1

(12) United States Patent
DiLuzio et al.

(10) Patent No.: US 9,765,534 B1
(45) Date of Patent: Sep. 19, 2017

(54) CONCRETE WORK TOOL, METHOD OF MAKING, AND APPLICATIONS

(71) Applicants: Albert DiLuzio, Vestal, NY (US); Mark Rutledge Garofano, Syracuse, NY (US)

(72) Inventors: Albert DiLuzio, Vestal, NY (US); Mark Rutledge Garofano, Syracuse, NY (US)

(73) Assignee: Albert Diluzio, Vestal, NY (US)

( * ) Notice: Subject to any disclaimer, the term of this patent is extended or adjusted under 35 U.S.C. 154(b) by 0 days.

(21) Appl. No.: 15/350,274

(22) Filed: Nov. 14, 2016

(51) Int. Cl.
*E04F 21/24* (2006.01)
*E01C 19/44* (2006.01)

(52) U.S. Cl.
CPC ..... *E04F 21/241* (2013.01); *E01C 19/44* (2013.01)

(58) Field of Classification Search
CPC ..... E02D 3/068; E02D 3/046; E02D 3/074; E02D 3/00; E01C 19/44; E01C 19/38; E04F 21/241
See application file for complete search history.

(56) References Cited

U.S. PATENT DOCUMENTS 123,986 A * 2/1872 Faehtz ..... E02D 3/068 404/133.1
2,845,050 A * 7/1958 Wacker ..... E02D 3/068 123/46 R
3,213,476 A * 10/1965 Lasker ..... E01C 19/44 15/235.4
3,314,341 A * 4/1967 Schulin ..... E02D 3/046 15/49.1
3,342,118 A * 9/1967 Beierlein ..... E02D 3/074 404/113
3,606,796 A * 9/1971 Pappers ..... B06B 1/164 404/117
4,156,576 A * 5/1979 Clavel ..... E02D 3/068 173/210
4,343,568 A * 8/1982 Kaltenegger ..... E02D 3/074 404/114
4,402,629 A * 9/1983 Gurries ..... E02D 3/046 173/210
4,790,687 A * 12/1988 Wright ..... E02D 3/046 37/367
5,261,762 A * 11/1993 Yamaguchi ..... E01C 19/35 404/117
6,302,622 B1 * 10/2001 Nagasawa ..... E01C 19/35 404/133.05

(Continued)

*Primary Examiner* — Abigail A Risic
(74) *Attorney, Agent, or Firm* — Bond, Schoeneck & King, PLLC; William Greener

(57) ABSTRACT

A concrete float body whose bottom (working) surface has a 3D shape/profile/contour over a nose region and a tail region of the float body. The nose region may be tapered across a width dimension of the float body. The tail region may be tapered across a width dimension of the float body. The nose and tail regions may have rounded corners. A perimetal edge of the float body may have a radius. The 3D surface may be produced by extruding, cutting from a solid material, die cast molding, or injection molding the float body wherein the bottom surface has a curvilinear shape along the width dimension, and monotonically decreasing a thickness dimension of the float body between the bottom surface and a top surface by removing material from the bottom surface.

15 Claims, 7 Drawing Sheets

(56) References Cited

U.S. PATENT DOCUMENTS

| | | | | |
|---|---|---|---|---|
| 6,409,426 | B1 * | 6/2002 | MacLellan | E01C 19/38 404/133.05 |
| 6,659,685 | B1 * | 12/2003 | Persson | E02D 3/046 404/133.05 |
| 7,316,524 | B1 * | 1/2008 | Pikuet | E01C 19/38 404/114 |
| 2007/0077128 | A1 * | 4/2007 | Wissmann | E02D 3/046 405/232 |
| 2007/0292208 | A1 * | 12/2007 | Lutz | E01C 19/402 404/114 |
| 2010/0239368 | A1 * | 9/2010 | Lickel | E01C 19/006 404/84.5 |
| 2011/0013982 | A1 * | 1/2011 | Prohaska | E02D 3/046 404/72 |
| 2011/0123269 | A1 * | 5/2011 | Lutz | E01C 19/42 404/118 |
| 2016/0097176 | A1 * | 4/2016 | Hamilton | E02D 3/046 173/206 |

* cited by examiner

CONCRETE WORK TOOL, METHOD OF MAKING, AND APPLICATIONS

BACKGROUND

Aspects and embodiments of the invention are most generally directed to a concrete work tool, a method for making a concrete work tool, and applications for use of a concrete work tool. Aspects and embodiments are more particularly directed to a concrete float having a particular shape and a method for making the concrete float; most particularly to a concrete float having a 3-D-shaped bottom surface, a method for making the concrete float, and applications for use of the concrete float.

The objective to pouring and finishing concrete is to produce a finished product that is level, smooth and sealed. A smooth and sealed final product is accomplished in two ways: firstly, by leveling the newly poured concrete with a large straight edge (screed); and secondly, by working the concrete with a concrete float by hand to further level and seal the concrete. Finish leveling and sealing the concrete is accomplished by creating what is known as cream to fill in low and unlevel spots atop of the surface. What's known as cream is the result of hand floats and 'finish-men' smoothing and leveling the concrete. Cream is created when the cement and other ingredients in concrete are agitated back and forth by hand with concrete floats. The purpose to create cream is to use the cream to fill in and level the concrete as is begins to setup (harden).

Traditionally, a finish float is a hand held tool that is straight and level. The float is moved across the surface of the concrete back and forth, west to east, east to west, north to south, south to north, and in random directions in the path of circles or half-moon shapes. These motions help level high areas within the concrete while making cream that can be used to fill in low areas. This process is known as working or finishing the concrete. The final result of finishing concrete should be a smooth level surface. The finish tool should be helpful in leveling the concrete to remove all imperfections.

Traditional and currently available concrete floats have shapes, non-functional tool edges, and other design features and characteristics (e.g., flat bottom surfaces), which make it easy for the float to dig into the fresh concrete, leave marks, and/or make it otherwise difficult and heavy to use. The inventor has recognized the advantages and benefits of a tool/float that addresses these issues; that is, one that is easier to use and which performs better by not leaving as many or any lines or marks in fresh concrete as a traditional float. These advantages and benefits are achieved and enabled by the embodied float exhibiting one or more of material reduction from specific areas of the tool to reduce weight as to reduce fatigue of a 'finish man,' 3D nose and/or tail section bottom surfaces that provide greater ease of use, even for a less-experienced finish persons, a properly rounded edge radius that allows the user to pass the float along the surface of the concrete without digging-in, allowing the user to raise the float at a sharper angle which further allows the user to scrap, drag, push and pull cream over the concrete to level and seal the surface without thinning cream too much, which can cause pre-mature sealing of the concrete surface.

SUMMARY

An aspect of the invention is a concrete work tool in the form of a concrete float. In a non-limiting, exemplary embodiment the float includes an elongate float body characterized by a length dimension, L, and a width dimension, W, wherein L is equal to or greater than 2W, having a bottom surface, further wherein at least a portion of the bottom surface has a curvilinear shape along the width dimension. In various non-limiting embodiments, the float may be further characterized by one or more of the following features, limitations, characteristics, components, separately or in various combinations as a person skilled in the art would understand:

- wherein the at least the portion of the bottom surface having the curvilinear shape along the width dimension is at least one of a nose section of the float body and a tail section of the float body;
- wherein the at least the portion of the bottom surface having the curvilinear shape has a monotonically decreasing thickness between the bottom surface and a top surface of the float body over a selected length approaching at least one of an end of the nose section and an end of the tail section of the float body, wherein the bottom surface is inclined with respect to a non-inclined top surface such that the bottom surface of the at least one of the nose section and the tail section has a three-dimensional shape;
- wherein both the nose section of the float body and the tail section of the float body have the curvilinear shape along the width dimension;
  - wherein both the nose section of the float body and the tail section of the float body have a monotonically decreasing thickness between the bottom surface and the top surface of the float body over a selected length approaching the end of the nose section and the end of the tail section of the float body;
  - wherein at least the end of the nose section has curvilinear corners;
  - wherein a perimeter edge of the float body is curvilinear;
  - further comprising a handle attached to a top surface of the float body;
- wherein the nose section of the float body has a monotonically decreasing width dimension over a selected length approaching an end of the nose section.

An aspect of the invention is a method for making a concrete work tool in the form of a concrete float. In a non-limiting, exemplary embodiment the method includes the steps of providing an elongate float body characterized by a length dimension, L, and a width dimension, W, wherein L is equal to or greater than 2W, having a bottom surface, further wherein at least a portion of the bottom surface has a curvilinear shape along the width dimension; and starting from a location no greater than a midpoint along the length dimension of the bottom surface towards at least one of a nose end and a tail end of the float body, monotonically decreasing a thickness dimension of the float body between the bottom surface and a top surface by removing material from the bottom surface. In various non-limiting embodiments, the method may further include one or more of the following features, steps, limitations, characteristics, components, separately or in various combinations as a person skilled in the art would understand:

- further comprising symmetrically tapering the nose section of the float body across the width dimension such that a leading edge of the nose section has a reduced width dimension;
- in which the leading edge of the tapered nose section has a straight portion intermediate opposing curvilinear sections;

further comprising providing a radius to at least a portion of a perimetal edge of the float body;

further comprising providing the radius to opposing perimetal edge regions along the length dimension of the float body;

wherein providing an elongate float body having a curvilinear bottom surface along the width dimension comprises extruding the float body;

further comprising attaching a handle to the float body.

DETAILED DESCRIPTION OF NON-LIMITING, EXEMPLARY EMBODIMENTS OF THE INVENTION

Figure 1:
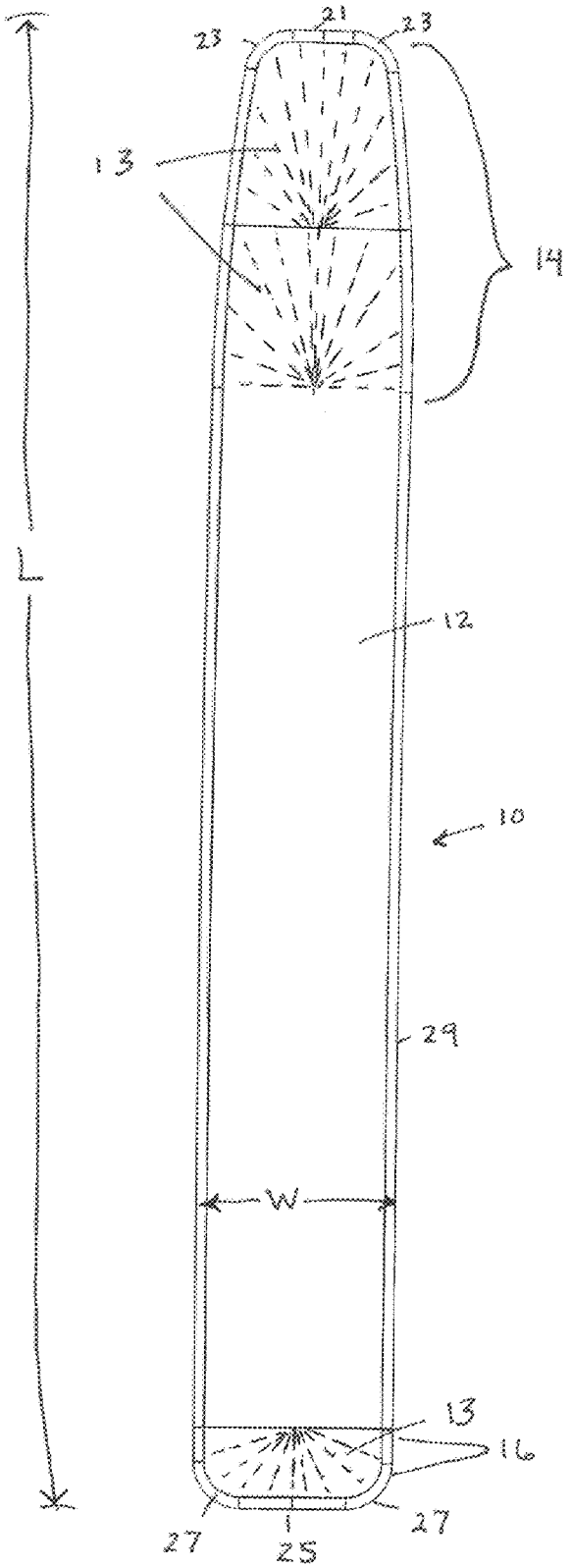
FIG. 1 is a bottom plan view of the float body, particularly showing 3D-shaped nose and tail sections of the bottom surface of the float body as well as a tapered nose section along a width dimension of the float body, according to an exemplary, illustrative embodiment of the invention.

In its most general aspect, the invention is a concrete float body 10 (FIG. 1) whose bottom (working) surface 12 has a 3D shape/profile/contour over a nose region 14 and a tail region 16 of the float body. This is generally illustrated by the radiating dashed lines 13.

FIG. 1 further shows the elongate float body characterized by a length dimension, L, and a width dimension, W, wherein L is equal to or greater than 2W. Typical traditional values of L and W for a finish float are about 16 inches (e.g., 15.875 in) and about two inches (e.g., 2.125 in), respectively. According to various embodiments, L may be about eight to 36 inches and W may be about two to four inches. Further shown is the symmetrically tapered nose section 14 in the width dimension with a straight portion 21 between two opposing curvilinear portions 23, and at the tail end 16 a straight portion 25 between two opposing curvilinear portions 27. Further shown is the radiused perimetal edge 29 of the float body. Embodied float body materials may be magnesium, plastic, aluminum, or other suitable material that can be extruded and produced with the design characteristics and shape features described herein.

Figure 2:
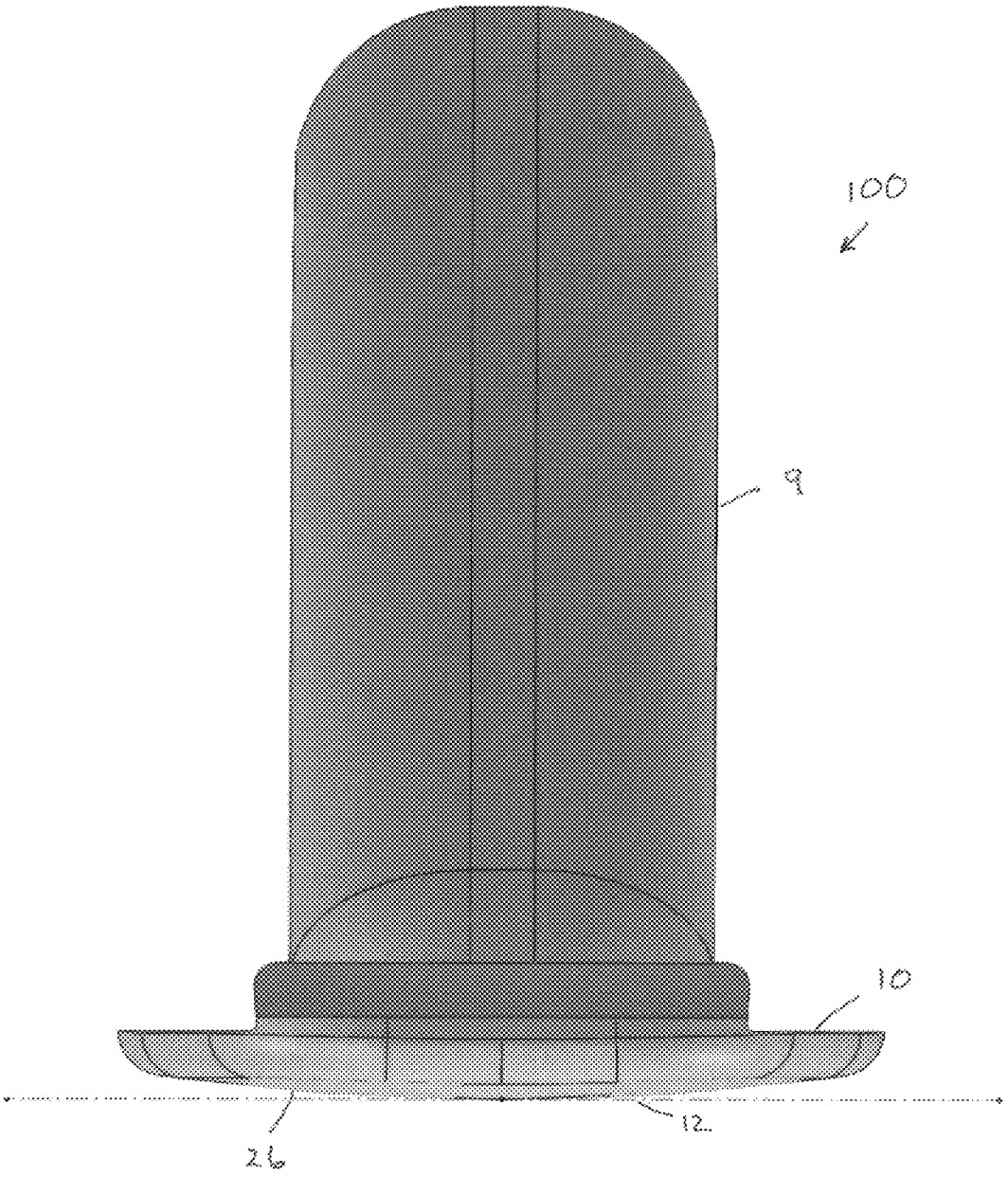
FIG. 2 is a front cross sectional view of a float (including a handle) that illustrates the 2D curvilinear shape of the bottom surface across the width dimension of the float body, according to an illustrative embodiment of the invention.

FIG. 2 is a front cross sectional view of a float 100 (including a handle 9, not part of the invention per se) that illustrates the 2D curvilinear shape/profile 26 of the bottom surface across the width dimension of the float body. Once a particular curvature or curvilinear shape 26 is chosen for the bottom surface 12, the float body may advantageously be made by known processes including extrusion, cutting from solid material, die cast molding, or injection molding such that the bottom surface is uniformly curved in 2D (across width dimension, W) along the entire length, L, of the float body. In a particular non-limiting, exemplary embodiment the reduction of material from the centerline of the bottom surface to the left and right sides over a total width dimension, W, of about two to four inches is between 0.03-0.25 in. In a prototype embodiment, a 0.07 in reduction of material demonstrated satisfactory results.

Figure 3:
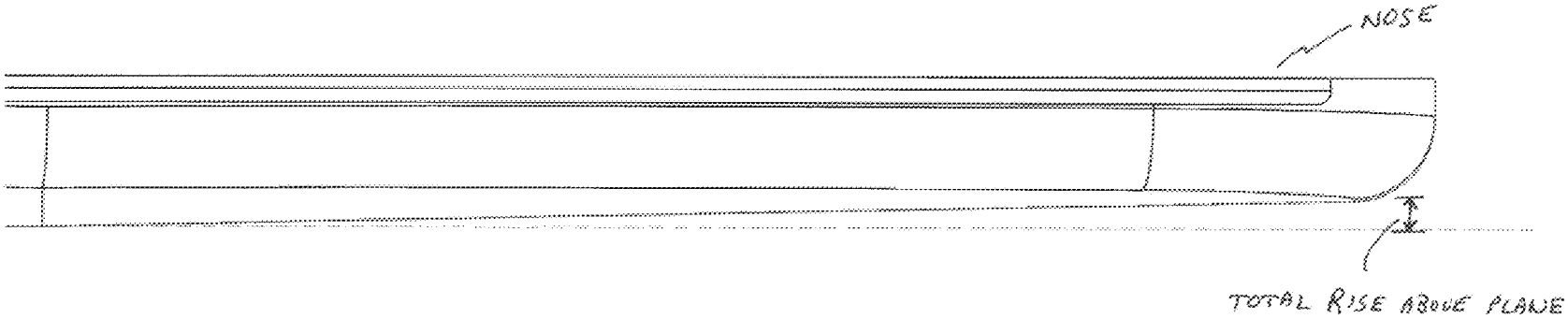
FIG. 3 is a side cross sectional view of a mid-to-nose end region of the float body illustrating the monotonic taper of the bottom surface towards the nose tip to impart a 3D shape on the 2D curvilinear bottom surface of the float body, according to an exemplary, illustrative embodiment of the invention.

FIG. 3 is a side cross sectional view of a mid-to-nose end region of the float body illustrating the monotonic taper of the bottom surface towards the nose tip to impart a 3D shape on the 2D curvilinear bottom surface of the float body. In a particular non-limiting, exemplary embodiment the reduction of material at the nose tip may advantageously be about 0.015 in (1/64) to about 0.07 in (5/64) less than the dimension at 3.878 inches back from the tip. In a prototype embodiment, a 0.047 in (3/64) reduction of material demonstrated satisfactory results.

Figure 4:
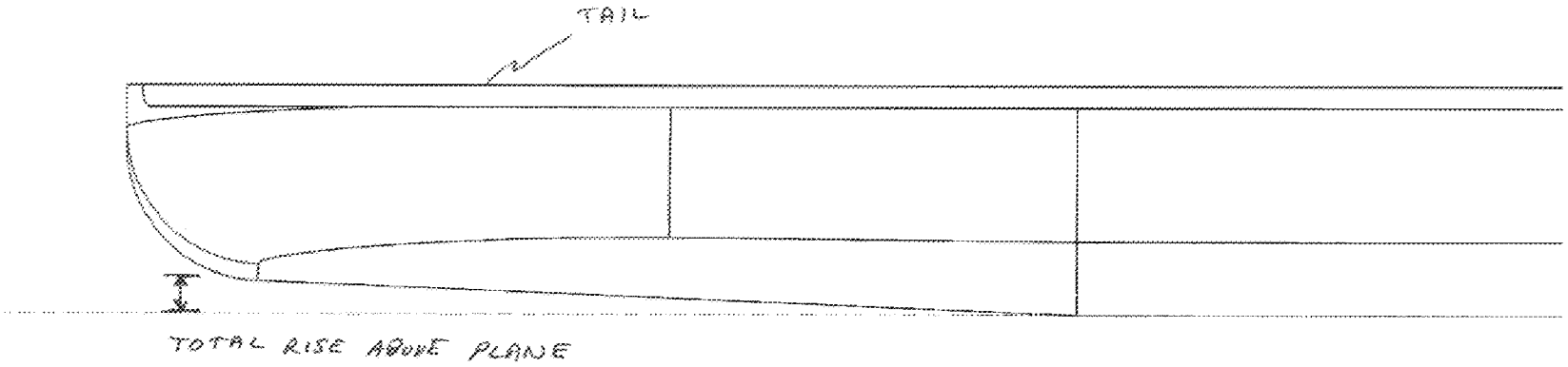
FIG. 4 is a side cross sectional view of a mid-to-tail end region of the float body illustrating the monotonic taper of the bottom surface towards the tail tip to impart a 3D shape on the 2D curvilinear bottom surface of the float body, according to an exemplary, illustrative embodiment of the invention.

FIG. 4 is a side cross sectional view of a mid-to-tail end region of the float body illustrating the monotonic taper of the bottom surface towards the tail tip to impart a 3D shape on the 2D curvilinear bottom surface of the float body. In a particular non-limiting, exemplary embodiment the reduction of material at the tail tip may advantageously be about 0.015 in (1/64) to about 0.07 in (5/64) less than the dimension at 0.875 inches back from the tip. In a prototype embodiment, a 0.030-0.035 in (1/32) reduction of material demonstrated satisfactory results.

Figure 5:
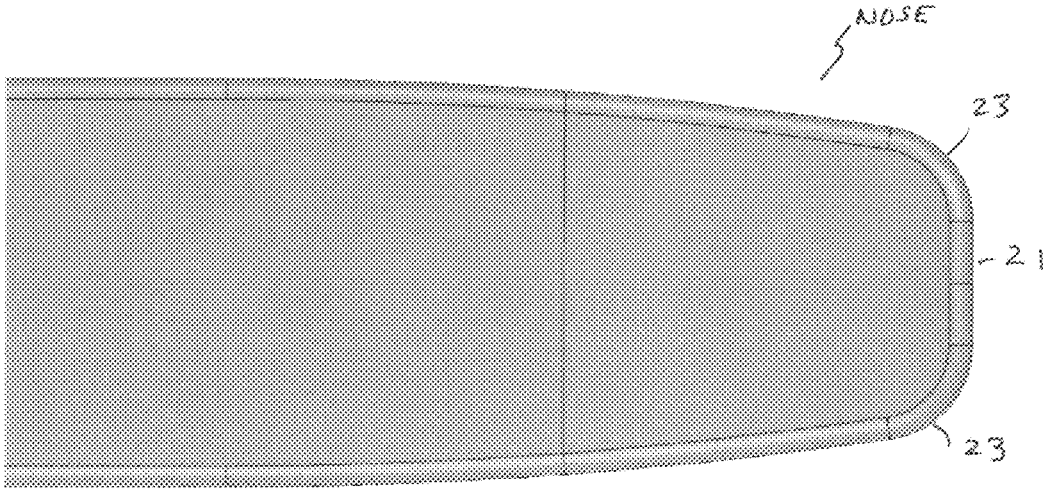
FIG. 5 is a schematic bottom plan view of a mid-to-nose end region of the float body illustrating both the symmetrical taper of the nose end across the width dimension of the float body with rounded or curvilinear regions at the nose tip and the radiused perimetal edge of the float body, according to an exemplary, illustrative embodiment of the invention.
Figure 7:
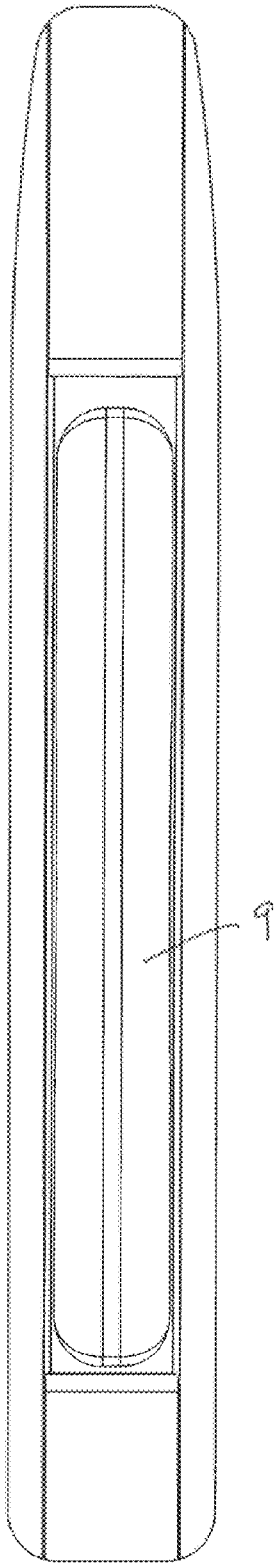
FIG. 7 is a top plan view of the float including a handle attached to the top surface of the float body, according to an exemplary, illustrative embodiment of the invention.

In addition to the 3D-shaped bottom surface of the float body described hereinabove, the float body approaching the nose end may advantageously taper across the width dimension, W, as illustrated in FIGS. 1, 5, and 7. At the nose tip, the float body has a straight portion 21 between two opposing curvilinear end regions 23 (FIG. 1). The straight portion comprises about 1/3 to about 3/4 of the tip width. FIG. 5 is a schematic bottom plan view of prototype embodiment of a 16 in long float body, illustrating the symmetrical taper of the nose end across the width dimension of the float body with rounded or curvilinear regions at the nose tip and the radiused perimetal edge of the float body. In the illustrated, exemplary embodiment having a W dimension of 2.125 in, the straight portion of the tip 21 was 0.64 in followed by a 1/2 in radius to each side 23. The 1/2 in radius is followed by a tapered 1.691 in length that is 0.889 in from the bisected center, and another taper that is 1.754 in, which ends 3.876 from the nose tip and 0.955 from the bisected center.

Figure 6:
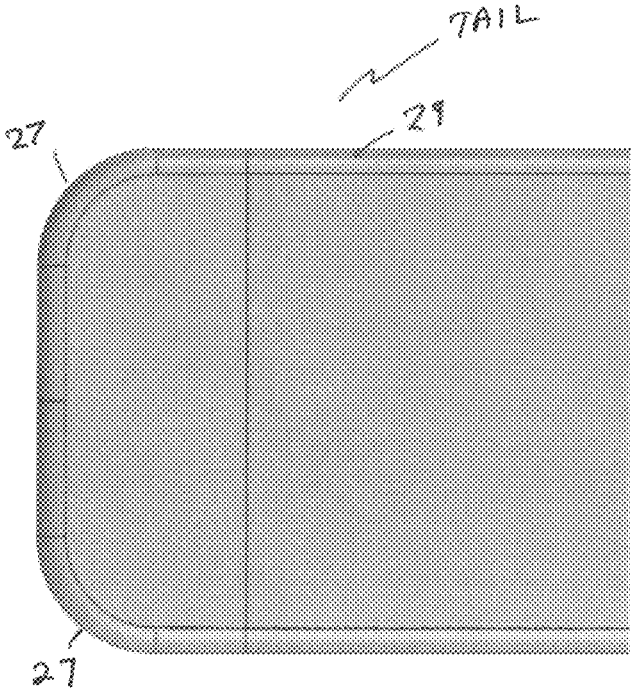
FIG. 6 is a schematic bottom plan view of a mid-to-tail end region of the float body illustrating both rounded, or curvilinear, regions at the tail tip and the radiused perimetal edge of the float body, according to an exemplary, illustrative embodiment of the invention.

FIG. 6 is a similar (to FIG. 5) schematic bottom plan view of a mid-to-tail end region of the float body illustrating both rounded, or curvilinear, regions 27 at the tail tip and the 1/8 in radiused perimetal edge 29 of the float body. Here, the straight portion is 1.138 in followed by a 1/2 in radius to each side 27. The 1/2 in radius 27 is followed by a straight 0.376 in length that is 0.955 in from the bisected center.

It is to be appreciated that all of the disclosed dimensions may be linearly scaled to different L and W dimensions of the float body.

FIG. 7 is a top plan view of the float including a handle 9 attached to the top surface of the float body.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

We claim:

1. A concrete work tool in the form of a concrete float, comprising:

an elongate float body characterized by a length dimension, L, and a width dimension, W, wherein L is equal to or greater than 2W, having a bottom surface, wherein at least a portion of the bottom surface has a curvilinear shape along a full lateral expanse of the width dimension, further wherein at least the portion of the bottom surface having the curvilinear shape is inclined with respect to a top surface of the float body along the length dimension, L, over a selected length towards at least one of a nose end and a tail end of the float body, such that the bottom surface of at least one of the nose end and the tail end has a three-dimensional shape.

2. The concrete work tool of claim 1, wherein the at least the portion of the bottom surface having the curvilinear shape along the width dimension is at least one of a nose section of the float body and a tail section of the float body.

3. The concrete work tool of claim 2, wherein both the nose section of the float body and the tail section of the float body have the curvilinear shape along the width dimension.

4. The concrete work tool of claim 1, wherein both the nose section of the float body and the tail section of the float body have a monotonically decreasing thickness between the bottom surface and the top surface of the float body over a selected length approaching the end of the nose section and the end of the tail section of the float body.

5. The concrete work tool of claim 2, wherein the nose section of the float body has a monotonically decreasing width dimension over a selected length approaching an end of the nose section.

6. The concrete work tool of claim 1, wherein at least the end of the nose section has curvilinear corners.

7. The concrete work tool of claim 1, wherein a perimeter edge of the float body is curvilinear.

8. The concrete work tool of claim 1, further comprising a handle attached to a top surface of the float body.

9. A method for making a concrete work tool in the form of a concrete float, comprising:

providing an elongate float body characterized by a length dimension, L, and a width dimension, W, wherein L is equal to or greater than 2W, having a bottom surface, further wherein at least a portion of the bottom surface has a curvilinear shape along a full lateral expanse of the width dimension; and starting from a location no greater than a midpoint along the length dimension of the bottom surface towards at least one of a nose end and a tail end of the float body, monotonically inclining the bottom surface with respect to a top surface by decreasing a thickness dimension of at least a portion of the float body.

10. The method of claim 9, further comprising symmetrically tapering the nose section of the float body across the width dimension such that a leading edge of the nose section has a reduced width dimension.

11. The method of claim 10, in which the leading edge of the tapered nose section has a straight portion intermediate opposing curvilinear sections.

12. The method of claim 9, further comprising providing a radius to at least a portion of a perimetal edge of the float body.

13. The method of claim 9, further comprising providing the radius to opposing perimetal edge regions along the length dimension of the float body.

14. The method of claim 9, wherein providing an elongate float body having a curvilinear bottom surface along the width dimension comprises extruding the float body.

15. The method of claim 9, further comprising attaching a handle to the float body.

* * * * *